United States Patent [19]
Pomerantz
[11] 4,290,400
[45] Sep. 22, 1981

[54] CLOSED LOOP FUEL CONTROL SYSTEM FOR AN INTERNAL COMBUSTION ENGINE

[75] Inventor: Allen J. Pomerantz, Bancroft, Mich.
[73] Assignee: General Motors Corporation, Detroit, Mich.

[21] Appl. No.: 131,085
[22] Filed: Mar. 17, 1980
[51] Int. Cl.³ ..... F02B 33/00; F02M 7/00
[52] U.S. Cl. ..... 123/440
[58] Field of Search ..... 123/440, 389

[56] References Cited

U.S. PATENT DOCUMENTS

| | | | |
|---|---|---|---|
| 4,123,999 | 11/1978 | Asano | 123/440 |
| 4,210,106 | 7/1980 | Wessel | 123/489 |
| 4,241,710 | 12/1980 | Peterson | 123/440 |
| 4,244,340 | 1/1981 | Herth | 123/440 |

*Primary Examiner*—Ronald B. Cox
*Attorney, Agent, or Firm*—Howard N. Conkey

[57] ABSTRACT

A closed loop fuel control system for an internal combustion engine is responsive to the output of a sensor monitoring the air/fuel ratio of the exhaust gases in the exhaust gas passage from the engine and therefore, after a transport time delay period dependent upon engine operating conditions, to the air/fuel ratio of the mixture supplied to the intake space of the engine and generates a first signal having a value preset to zero at each change in the sense of deviation of the sensed air/fuel ratio from a stoichiometric ratio and varying thereafter at a predetermined rate dependent upon the transport time delay and a second signal having a constant value for the period of the transport time delay after a change in the sense of deviation of the air/fuel ratio from a stoichiometric ratio and thereafter varying at the predetermined rate and in a sense determined by the sense of deviation of the air/fuel ratio from the predetermined ratio. The controller adjusts the air/fuel ratio of the mixture supplied to the engine in accord with the sum of the first and second signals and in a direction tending to produce the stoichiometric ratio.

4 Claims, 6 Drawing Figures

CLOSED LOOP FUEL CONTROL SYSTEM FOR AN INTERNAL COMBUSTION ENGINE

This invention is directed toward a closed loop air-fuel ratio control system for an internal combustion engine.

Closed loop air/fuel ratio control systems for internal combustion engines are generally known. Typically, these systems include an air/fuel ratio sensor responsive to the engine exhaust gases to provide a signal representing at least the sense of deviation of the air/fuel ratio from the stoichiometric ratio. These systems also typically include an integral or integral plus proportional controller responsive to the sense of deviation of the air/fuel ratio from the stoichiometric ratio to provide a control signal in the form of ramp and step functions which adjust the air/fuel ratio in the direction tending to produce a stoichiometric ratio.

A characteristic of these systems is their limit cycling resulting primarily from the transport delay of the engine. This transport delay is the time from the supplying of an air and fuel mixture to the intake space of the internal combustion engine and the time at which the oxygen sensor senses the air/fuel ratio in the exhaust passage. The resulting control signal for adjusting the air/fuel ratio limit cycles around the value required to produce a stoichiometric ratio with the amplitude of the limit cycle being determined by the value of the transport delay and the integral and proportional gains.

Integral and proportional gains large enough to produce satisfactory response to transient air/fuel ratio conditions result in excessive limit cycle amplitudes during periods where the transport delay is substantially long. Conversely, when the gains are low enough to obtain a desirable limit cycle amplitude at engine operating conditions resulting in long transport delay periods, the controller response to air/fuel transient conditions may be undesirable. Further, with a constant proportional gain or step value, the air/fuel ratio overshoot (limit cycle amplitude) will not be fully compensated for all values of transport delays. For example, a proportional step that returns the air/fuel ratio to stoichiometry at one transport delay time will not return the air/fuel ratio to stoichiometry at an air/fuel ratio sensor transition between rich and lean at longer transport delay values and will overshoot the stoichiometric ratio at shorter transport delay values. In order to adjust the closed loop performance to provide acceptable response for varying values of transport delay and for air/fuel ratio transient conditions, it has previously been proposed to adjust the integral or integral and proportional gains in accord with engine parameters which may include engine speed and load.

It is the general object of this invention to provide for an improved closed loop air and fuel ratio controller for an internal combustion engine.

It is another object of this invention to provide a closed loop air/fuel ratio controller for an internal combustion engine providing a control signal having a steady state limit cycle amplitude that is constant over the operating range of the engine and varying engine transport delay periods.

It is another object of this invention to provide a closed loop air/fuel ratio controller for an internal combustion engine wherein the value of the control signal for adjusting the air and fuel ratio is set to a value producing the stoichiometric ratio with each change in the sense of deviation of the air/fuel ratio from a predetermined ratio.

Another object of this invention is to provide a closed loop air/fuel ratio controller for an internal combustion engine providing a control signal having an integral term varied over a certain time period by a percentage of a desired limit cycle amplitude that is equal to the percentage of the existing engine transport delay period represented by the certain time period.

Another object of this invention is to provide a closed loop air/fuel ratio controller for an internal combustion engine providing a control signal comprised of the sum of two component signals cooperating to maintain a constant limit cycle amplitude and to return the air/fuel ratio to the stoichiometric ratio at each transition of the air/fuel ratio relative to the stoichiometric ratio over the operating range of the engine and for all values of the engine transport delay.

These and other objects of this invention may be best understood by reference to the following description of a preferred embodiment and the drawings in which.

Figure 1:
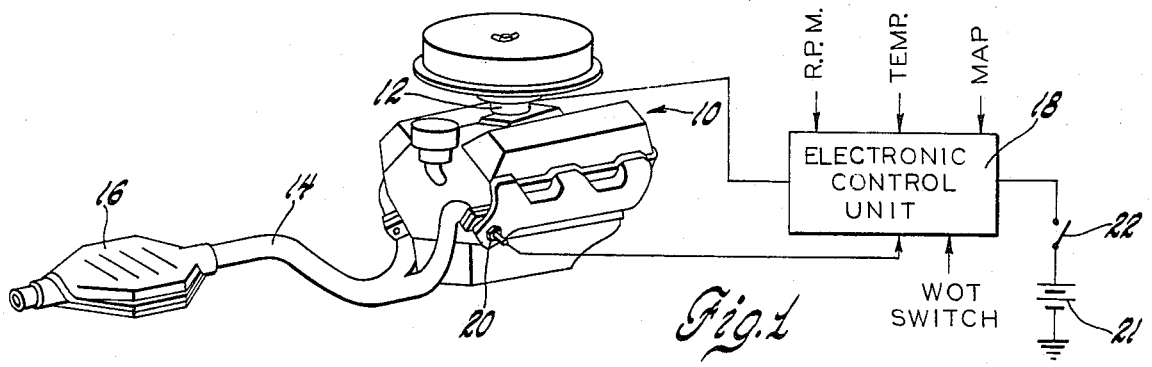
FIG. 1 illustrates an internal combustion engine incorporating a closed loop control system for adjusting the air/fuel ratio of the mixture supplied to the engine in accord with the principles of this invention.
Figure 2:
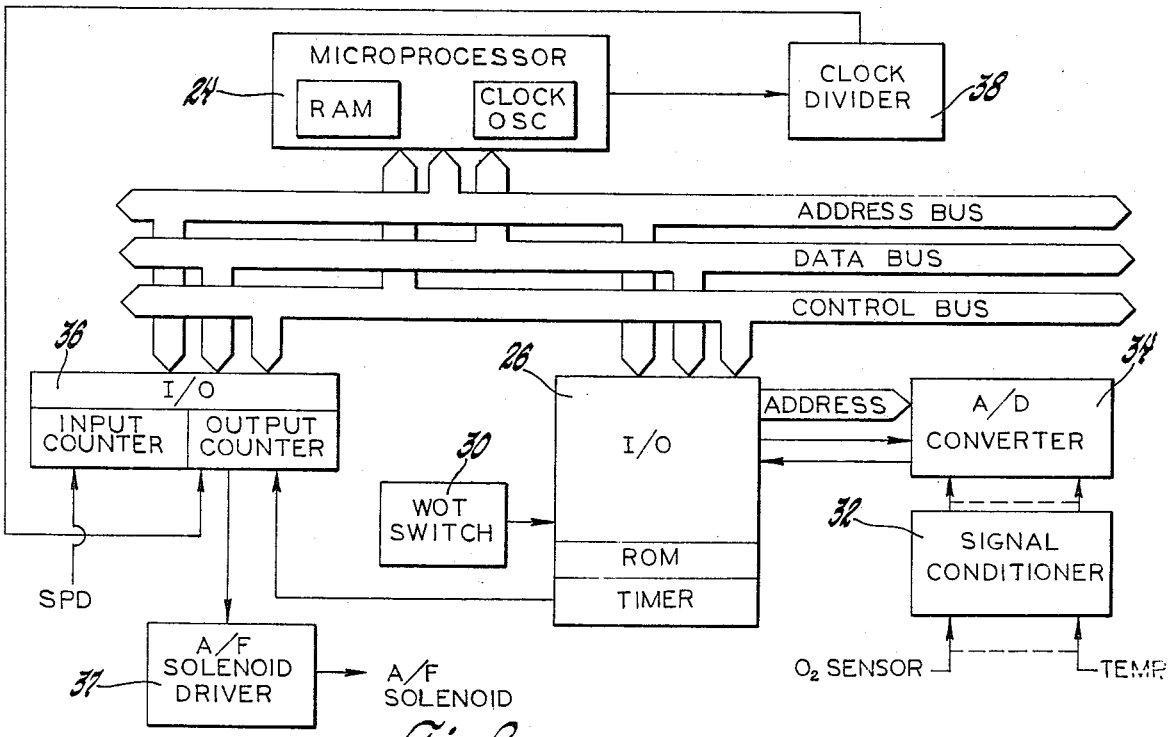
FIG. 2 illustrates a digital form of the electronic control unit of FIG. 1 for controlling the air and fuel mixture in accord with the principles of this invention.
Figure 5:
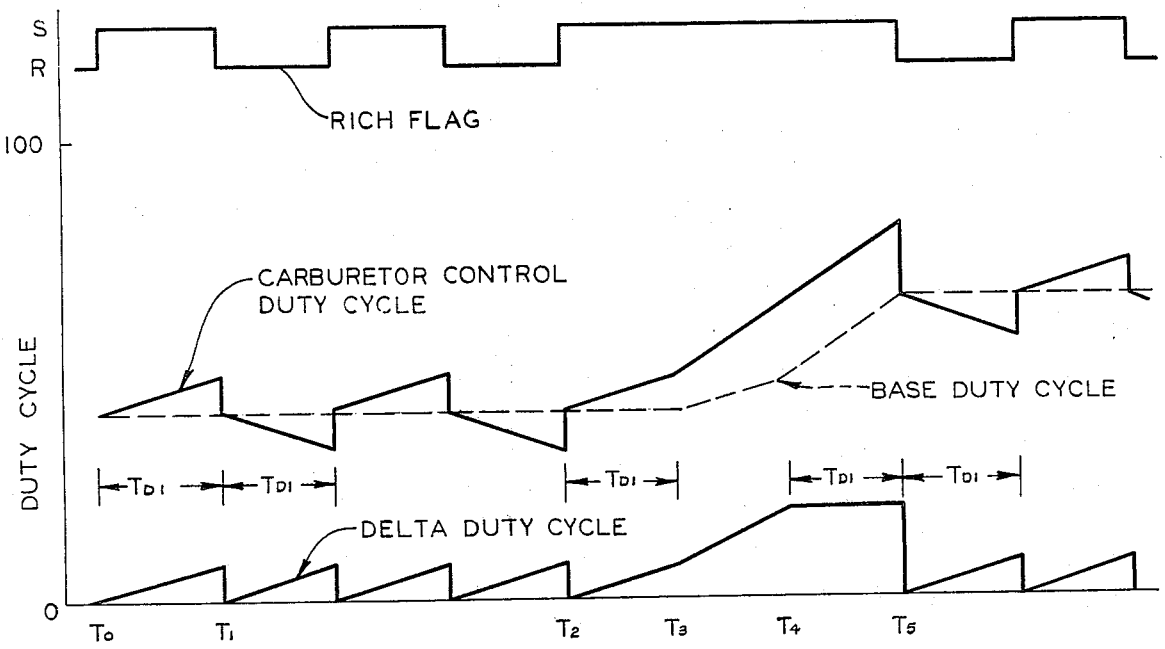
Figure 6:
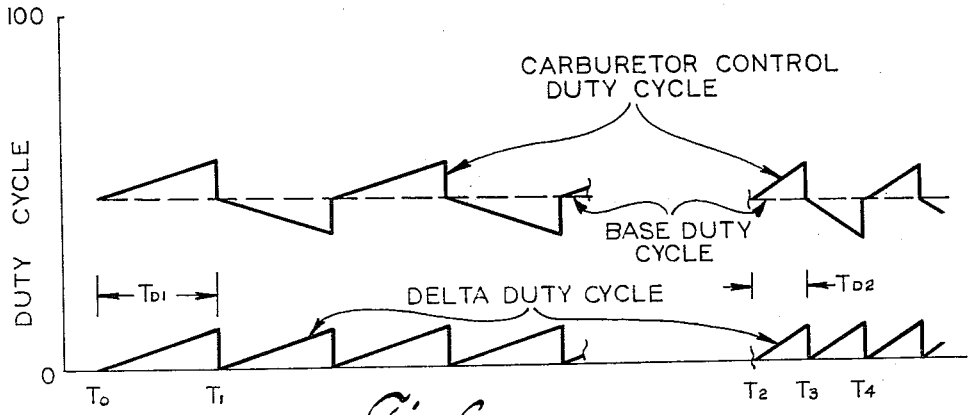

FIG. 5 is a diagram illustrative of the control signal generated for controlling the air/fuel ratio of the mixture supplied to the engine of FIG. 1 for steady state and transient air/fuel ratio conditions; and FIG. 6 is a diagram illustrating the control signal provided by the digital system of FIG. 2 for adjusting the air/fuel ratio of the mixture supplied to the engine of FIG. 1 for different values of engine transport delays.

Referring to FIG. 1, an internal combustion engine 10 is supplied with a controlled mixture of fuel and air by a carburetor 12. The combustion byproducts from the engine 10 are exhausted to the atmosphere through an exhaust conduit 14 which includes a threeway catalytic converter 16.

The air/fuel ratio of the mixture supplied by the carburetor 12 is selectively controlled either open loop or closed loop by means of an electronic control unit 18. During open loop control, the electronic control unit 18 is responsive to predetermined engine operating parameters to generate an open loop carburetor control signal to adjust the air/fuel ratio of the mixture supplied by the carburetor 12 in accord with a predetermined schedule. When the conditions exist for closed loop operation, the electronic control unit 18 is responsive to the output of a conventional air/fuel ratio sensor 20 positioned at the discharge point of one of the exhaust manifolds of the engine 10 and which senses the exhaust discharged therefrom to generate a closed loop carburetor control signal including integral and proportional terms for controlling the carburetor 12 to obtain a predetermined ratio such as the stoichiometric ratio. The carburetor 12 includes an air/fuel ratio adjustment device that is responsive to the carburetor control signal output of the electronic control unit 18 to adjust the air/fuel ratio of the mixture supplied by the carburetor 12.

The carburetor control signal output of the electronic control unit 18 takes the form of a pulse width modulated signal at a constant frequency thereby forming a duty cycle modulated control signal. The pulse width of the signal output of the electronic control unit 18 is controlled with an open loop schedule during open loop operation where the conditions do not exist for closed loop operation and in response to the output of the sensor 20 during closed loop operation. The duty cycle modulated signal output of the electronic control unit 18 is coupled to the carburetor 12 to effect adjustment of the air/fuel ratio supplied by the fuel metering circuits therein. In the present embodiment, a low duty cycle output of the electronic control unit 18 provides for an enrichment of the mixture supplied by the carburetor 12 while a high duty cycle value is effective to lean the mixture.

An example of a carburetor 12 with a controller responsive to a duty cycle signal for adjusting the mixture supplied by both the idle and main fuel metering circuits is illustrated in the U.S. Pat. Application Ser. No. 051,978, filed June 25, 1979, by Donald D. Brokaw and Rolland D. Giampa and which is assigned to the assignee of this invention. In this form of carburetor, the duty cycle modulated control signal is applied to a solenoid which simultaneously adjusts elements in the idle and main fuel metering circuits to provide for air/fuel ratio adjustment.

The electronic control unit 18 also receives inputs from conventional sensors including an engine speed sensor providing a speed signal RPM, an engine coolant temperature sensor providing a temperature signal TEMP, a manifold absolute pressure sensor providing a pressure signal MAP and a wide open throttle signal input WOT provided by a throttle position switch activated when the position of the vehicle throttle is at a wide open position. The electronic control unit 18 receives power from a conventional vehicle battery 21 through an ignition switch 22.

A characteristic of the system of FIG. 1 is the transport time delay involved in the induction, combustion and exhaust processes. The engine 10 receives the air/fuel mixture from the carburetor 12 through the intake manifold, burns the mixture, and discharges it through the exhaust manifold past the exhaust sensor 20 and thereafter through the catalytic converter 16. Changes in the air/fuel mixture generated by carburetor error, distribution variations in the engine 10 and intake system, and transient effects due to flow variations through the engine 10 can be observed by the sensor 20 only after the transport time delay. Therefore, the engine has gone rich or lean sometime prior to the time that the sensor 20 sees the error. After the error is sensed, additional time is required for the electronic control unit 18 to correct for the sensed error. As a result of these delays, the proportional and integral control terms of the carburetor control signal causes the air/fuel ratio of the mixture supplied by the carburetor 12 to overshoot the stoichiometric air/fuel ratio by an amount determined by the transport delay and the gains of the carburetor control signal provided by the electronic control unit 18 during closed loop operation. Consequently, the system limit cycles with the amplitude and frequency of the oscillations of the limit cycles being determined by the time constants of the electronic control unit 18 and the transport delay.

In accord with this invention, the amplitude of the limit cycle and thereby the deviation of the air/fuel ratio from the stoichiometric ratio during steady state operation is maintained at a constant value for all engine operating conditions and varying transport delay times. This is accomplished by the electronic control unit 18 which has a computation cycle that is repeated at a constant frequency such as 10 hz. During each cycle, the integral control term is adjusted by an amount that is the same percentage of the desired limit cycle amplitude as the percentage of the existing value of the engine transport delay represented by the period of the computation cycle. For example, if the computation cycle is repeated each 100 milliseconds, and the engine transport delay determined by the existing engine operating conditions is one second, the period of the computation cycle is 10% of the engine transport delay and the integral control term is adjusted by an amount that is 10% of the desired limit cycle amplitude. In this manner, during the period of each transport delay period, the integral control term adjusts the air/fuel ratio through the predetermined limit cycle amplitude. When the sensor 20 detects a rich-lean transition in the air/fuel ratio relative to stoichiometry, the electronic control unit 18 shifts the duty cycle value of the carburetor control signal to the value that existed at the time prior to the transition in the air/fuel ratio by an amount equal to the transport delay, which value is representative of the value required to adjust the carburetor 12 to produce a stoichiometric ratio.

Referring to FIG. 2, the electronic control unit 18 in the preferred embodiment takes the form of a digital computer that provides a pulse width modulated signal at a constant frequency to the carburetor 12 to effect adjustment of the air/fuel ratio. The digital system includes a microprocessor 24 that controls the operation of the carburetor 12 by executing an operating program stored in an external read only memory (ROM). The microprocessor 24 may take the form of a combination module which includes a random access memory (RAM) and a clock oscillator in addition to the conventional counters, registers, accumulators, flag flip flops, etc., such as a Motorola Microprocessor MC-6802. Alternatively, the microprocessor 24 may take the form of a microprocessor utilizing an external RAM and clock oscillator.

The microprocessor 24 controls the carburetor 12 by executing an operating program stored in a ROM sectional of a combination module 26. The combination module 26 also includes an input/output interface and a programmable timer. The combination module 26 may take the form of a Motorola MC-6846 combination module. Alternatively, the digital system may include separate input/output interface modules in addition to an external ROM and timer. The input conditions upon which open loop and closed loop control of air/fuel ratio are based are provided to the input/output interface of the combination module 26. The discrete inputs such as the output of a wide open throttle switch 30 are coupled to discrete inputs of the input/output interface of the combination module 26. The analog signals including the air/fuel ratio signal from the sensor 20, the engine coolant temperature signal TEMP, and the manifold absolute pressure signal MAP are provided to a signal conditioner 32 whose outputs are coupled to an analog-to-digital converter multiplexer 34. The particular analog condition sampled and converted is controlled by the microprocessor 24 in accord with the operating program via the address lines from the input/output interface of the combination module 26. Upon command, the addressed condition is converted to digital form and supplied to the input/output interface of the combination circuit 26 and then stored in ROM designated memory locations in the RAM.

The duty cycle modulated output for controlling the air/fuel solenoid in the carburetor 12 is provided by an output counter section of an input/output interface circuit 36. The output pulses to the carburetor are provided via a conventional solenoid driver circuit 37. The output counter section receives a clock signal from a clock divider 38 and a 10 hz. signal from the timer section of the combination module 26. In general, the output counter section of the circuit 36 may include a register into which a binary number representative of the desired pulse width is inserted. Thereafter at the frequency of the 10 hz. signal from the timer section of the combination module 26, the number is gated into a down counter which is clocked by the output of the clock divider 38 with the output pulse of the output counter section having a duration equal to the time required for the down counter to be counted down to zero. In this respect, the output pulse may be provided by a logic circuit or a flip flop set when the number in the register is gated into the down counter and reset by a carry out signal from the down counter when the number is counted to zero.

The circuit 36 also includes an input counter section which receives speed pulses from an engine speed transducer or the engine distributor that gate clock pulses to a counter to provide an indication of engine speed.

The microprocessor 24, combination module 26 and the input/output interface circuit 36 are interconnected by an address bus, a data bus and a control bus. The microprocessor accesses the various circuits and memory locations in the ROM and RAM via the address bus. Information is transmitted between circuits via the data bus and the control bus includes lines such as read/write lines, reset lines, clock lines, etc.

As previously indicated, the microprocessor 24 reads data and controls the operation of the carburetor 12 by execution of its operating program as provided in the ROM section of the combination module 26. Under control of the program, various input signals are read and stored in ROM designated locations in the RAM section of the microprocessor 24 and the operations are performed for controlling the air and fuel mixture supplied by the carburetor 12.

Figure 3:
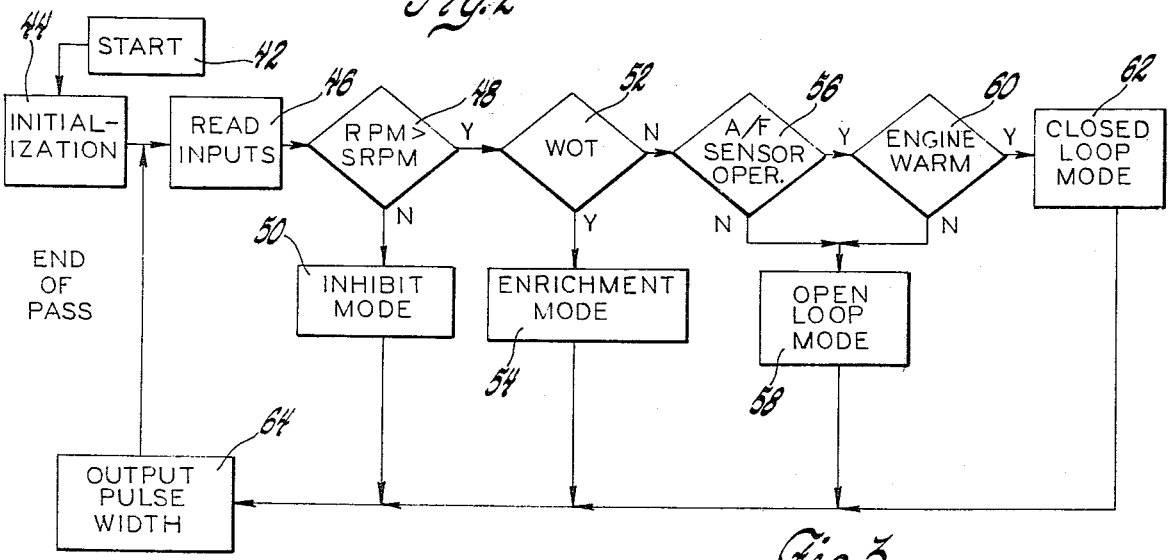
FIGS. 3 and 4 are diagrams illustrative of the operation of the digital controller of FIG. 2 resulting in an adjustment of the air and fuel ratio of the mixture supplied to the internal combustion engine of FIG. 1 in accord with the principles of this invention.

Referring to FIG. 3, there is illustrated the major loop portion of the computer program. The major loop is reexecuted every 100 milliseconds which is the desired frequency of the pulse width modulated signal provided to the carburetor 12. This frequency is determined by the timer portion of the combination module 26. The computer program is initiated at point 42 when power is first applied to the system by the vehicle operator upon closure of the ignition switch 22. The program then proceeds to step 44 where the computer provides for intialization of the system. For example, at this step, system initial values stored in the ROM are entered into ROM designated locations in the RAM in the microprocessor 24 and counters, flag flip flops and timers are initialized.

After the initialization step 44, the program proceeds to step 46 where the computer executes a read routine where certain parameters measured and determined during the prior major loop cycle are saved by inserting them into ROM designated RAM locations. For example, the state of a rich flag indicating the condition of the air/fuel ratio relative to a stoichiometric ratio is saved. Thereafter, the discrete inputs such as from the wide open throttle switch 30 are stored in ROM designated memory locations in the RAM, engine speed RPM as determined via the input counter of the input-/output circuit 36 is stored at a ROM designated storage location in the RAM and the various inputs to the analog-to-digital converter including the output signal of the sensor 20, the manifold absolute pressure signal MAP and the engine temperature signal TEMP are one by one converted by the analog-to-digital converter multiplexer 34 into a binary number representative of the analog signal value and stored in respective ROM designated memory locations in the RAM.

The computer program then proceeds to a decision point 48 wherein the engine speed RPM stored in the RAM at step 46 is read from the RAM and compared with a reference engine speed value SRPM that is less than the engine idle speed but greater than the cranking speed during engine starting. If the comparison indicates that the engine has not started, the program proceeds to an inhibit mode of operation at step 50 where the determined width of the pulse width modulated signal for controlling the carburetor 12 and which is stored at a RAM location designated by the ROM to store the carburetor control pulse width is set essentially to zero to thereby produce a zero percent duty cycle signal for setting the carburetor 12 to a rich setting to assist in the vehicle engine starting.

If at decision point 48 the comparison indicates that the engine is running, the major loop program cycle proceeds from decision point 48 to a decision point 52 where it is determined whether or not the engine is operating at wide open throttle thereby requiring power enrichment. This is accomplished by addressing and sampling the information stored in the ROM designated memory location in the RAM at which the condition of the wide open throttle switch 30 was stored at step 46. If the engine is at wide open throttle, the program cycle proceeds to a step 54 at which an enrichment code is executed wherein the width of the pulse width modulated signal required to control the carburetor for power enrichment is determined and stored in the RAM memory location assigned to store the carburetor control pulse width.

If the engine is not at wide open throttle, the major loop program cycle proceeds from the decision point 52 to a decision point 56 where the operational condition of the air/fuel ratio sensor 20 is determined. In this respect, the system may determine operation of the sensor 20 by parameters such as sensor temperature or sensor impedance. If the air/fuel sensor 20 is determined to be inoperative, the program proceeds to a step 58 at which an open loop mode is executed. During this mode, an open loop pulse width is determined in accord with input parameters such as engine temperature read and stored in the RAM at the program step 46. The determined open loop pulse width is stored in the RAM location assigned to store the carburetor control pulse width.

If at decision point 56 it is determined that the air/fuel sensor 20 is operational, the major loop program proceeds to a decision point 60 where the engine temperature TEMP stored in the RAM at step 46 is compared with a predetermined calibration value stored in the ROM. If the engine temperature is below this value, the computer program proceeds to the step 58 and executes the open loop mode routine as previously described. If the engine temperature is determined at step 60 to be greater than the calibration value, all of the conditions exist for closed loop control of air/fuel ratio and the major loop program proceeds to a step 62 where a closed loop routine is executed to determine the carburetor control signal pulse width in accord with the sensed air/fuel ratio. The determined closed loop pulse width is stored in the RAM location assigned to store the carburetor control pulse width.

From each of the program steps 50, 54, 58 and 62, the program cycle proceeds to a step 64 at which the carburetor control pulse width is read from the RAM and entered in the form of a binary number into the register in the output counter section of the input/output circuit 36. As previously indicated, the input counter 36 provides the pulse determined by the value of the binary number inserted therein representing the desired carburetor control pulse width and the frequency of the output of the clock divider 38. The initiation of the pulse output of the output counter section of the circuit 36 is controlled by the output timer in the combination module 26 resulting in a pulse width which, at the computer program cycle rate, defines the variable duty cycle control signal for adjusting the carburetor 12.

In accord with this invention, the integration rate of the closed loop control pulse width is controlled so that the amplitude of the limit cycle and therefore the air/fuel ratio deviation from the stoichiometric ratio during steady state conditions is constant at all engine operating points and is controlled so that at each rich-lean transition in the sensed air/fuel ratio relative to the stoichiometric ratio, the pulse width is set to the value that caused the transition. Further, when a transition in the air/fuel ratio is not sensed after a period equal to the transport delay has lapsed, a transient condition is identified and the integral rate of the closed loop pulse width is increased to improve system response to transient conditions.

In general, the closed loop control pulse width includes one component which is set to zero at each sensed transition in the air/fuel ratio relative to the stoichiometric value and that is thereafter varied by an amount in each major program cycle illustrated in FIG. 3 that is the same percentage of the desired limit cycle amplitude as the percentage of the transport delay represented by the major cycle period. If a transition of the air/fuel ratio is not sensed after a period equal to the transport delay has lapsed after a sensed transition in the air/fuel ratio, a change in the required carburetor control signal duty cycle is required to produce a stoichiometric ratio is indicated and a second component of the closed loop control pulse width is varied in the same manner as the first component in accord with the value of the transport delay. The carburetor control pulse width is equal to the sum of the first and second components (the sign of the first component being determined by the sense of deviation of the air/fuel ratio relative to a stoichiometric ratio). Upon each sensed transition in the air/fuel ratio at which time the first component is set to zero, the carburetor control pulse width is set to the value of the second component having a value substantially equal to the value of the closed loop control pulse width that caused the transition and which is substantially the value producing a stoichiometric ratio. While the value of the first component of the carburetor control signal pulse width may be held constant after the expiration of a transport delay and until a sensed transition in the air/fuel ratio occurs, in this embodiment the first component is increased after the expiration of a transport delay period resulting in an increase in the controller gain to provide improved transient response.

Figure 4:
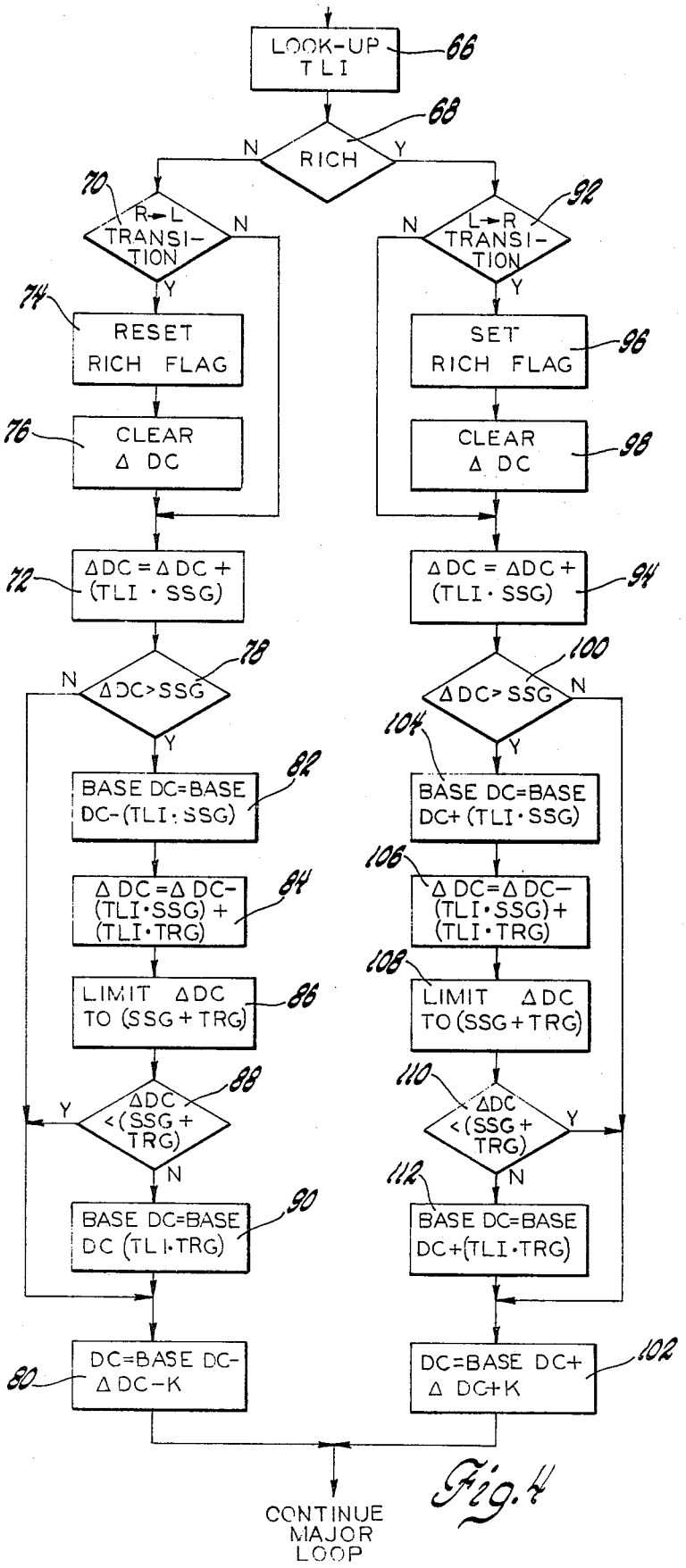

Referring to FIG. 4, there is illustrated the closed loop mode routine for controlling the air/fuel ratio of the mixture supplied to the engine 10 in accord with the principles of this invention. When the major loop cycle proceeds to the closed loop mode 62 of FIG. 3, the program proceeds to a step 66 where the transport lag inverse TLI is computed. This transport lag inverse is the fraction of the transport delay that a major cycle period represents. This value may be determined from engine operating parameters including engine speed and manifold vacuum and may be obtained from a lookup table in the ROM section of the combination module 26 addressed by those engine operating parameters. For example, assuming the engine transport delay at the existing engine operating condition is 1 second, the transport lag inverse is the fraction 1/10 assuming a 100 millisecond major cycle period. This fraction may be obtained by addressing a memory location in the lookup table by the value of engine speed and manifold absolute pressure and reading therefrom a number representing the fraction 1/10 which was previously stored in the ROM.

The program cycle then proceeds to a decision point 68 where the air/fuel ratio relative to the stoichiometric ratio is determined. This is accomplished by comparing the value of the oxygen sensor signal read and stored at step 46 with a predetermined value representing a stoichiometric ratio. If the comparison indicates that the air/fuel ratio is lean relative to the stoichiometric ratio, the program proceeds to a decision point 70 where it is determined whether or not a rich-to-lean transition in the air/fuel ratio has occurred since the prior major loop cycle. If the air/fuel ratio has not experienced a transition from rich-to-lean, the program proceeds to a step 72. However, if the air/fuel ratio has shifted from rich-to-lean since the prior major loop cycle, the program proceeds to a step 74 where the rich flag flip flop in the microprocessor 24 is reset to indicate that the air/fuel ratio is lean relative to the stoichiometric value. Thereafter, the program proceeds to a step 76 where a delta duty cycle value stored in a ROM designated location in the RAM section of a microprocessor 24 is cleared. This delta duty cycle signal is the first component of the closed loop carburetor control signal previously referred to. When cleared, this signal has a value of zero. From step 76, the program proceeds to the step 72.

At step 72, the delta duty cycle signal is varied by an amount determined by the value of the transport lag inverse determined at step 66 and the desired steady state limit cycle amplitude SSG. This is accomplished by adding a value to the delta duty cycle signal stored in the RAM determined by multiplying the transport lag inverse determined at step 66 by the desired limit cycle amplitude SSG. This value is then stored in the RAM section of the microprocessor 24. This routine results in the value of the delta duty cycle or first component of the closed loop carburetor control signal becoming equal to the desired steady state limit cycle amplitude SSG at the expiration of a transport delay period after each rich-to-lean transition of the air/fuel ratio as determined at step 70.

From step 72, the program proceeds to a step 78 where the value of the delta cycle signal stored in the RAM is compared with the desired steady state limit cycle amplitude SSG. If the value is less than the limit cycle amplitude indicating that a transport delay period has not lapsed, the program proceeds to a step 80. However, if the delta duty cycle signal is greater than the steady state limit cycle amplitude SSG indicating that a transport time delay period has lapsed since the rich-to-lean transition in the sensed air/fuel ratio relative to the stoichiometric value, the program proceeds to a step 82 where the value of a base duty cycle signal (the second component of the closed loop carburetor control signal previously described) stored in the RAM is determined. This base duty cycle value is set equal to the base duty cycle value previously stored in the RAM 24 minus an increment equal to the transport lag inverse TLI times the steady state limit cycle amplitude SSG. This increment is substantially equal to the increase in the delta duty cycle component of the closed loop control signal determined at step 72.

Following step 82, the program proceeds to a step 84 where the delta duty cycle component of the closed loop carburetor control signal is decreased by the amount of the steady state gain added at step 72 and increased by a value producing the desired transient gain of the controller. This is accomplished by adding an increment to the delta duty cycle value stored in the RAM that is equal to the transport lag inverse TLI multiplied by the value TRG producing the desired transient gain. From step 84, the program proceeds to step 86 where the delta duty cycle is limited to a value equal to the sum of the steady state limit cycle amplitude SSG and the transient gain value TRG.

From step 86, the program proceeds to the decision point 88 where the delta duty cycle or first component of the closed loop carburetor control signal is compared with the sum of the steady state limit cycle amplitude SSG and the transient gain value TRG. If the value is less than the sum, representing that a period equal to two transport delay periods has not lapsed, the program proceeds to the step 80. However, if at decision point 88 it is determined that the delta duty cycle signal is greater than the sum of the steady state limit cycle amplitude SSG and the transient gain value TRG indicating that a period equal to two transport delays has lapsed since the rich-to-lean transition determined at step 70, the program proceeds to a step 90 where the base duty cycle or second component of the closed loop carburetor control signal is set equal to the base duty cycle determined during the prior 100 millisecond major cycle period minus the increment equal to the transport lag inverse times the transient gain value TRG. This provides for a constant integral rate after a period of two transport delays has lapsed. From step 90, the program proceeds to the step 80.

At step 80, the closed loop carburetor control signal duty cycle stored in the RAM is set equal to the base duty cycle stored in the RAM minus the delta duty cycle stored in the RAM minus a constant value K to insure that the air/fuel ratio experiences a transition from lean-to-rich after the period of a transport delay during steady state operating conditions.

Following step 80, the program continues the major loop and proceeds to the step 64 where the closed loop carburetor pulse width is issued as previously described with reference to FIG. 3.

If at step 68 it is determined that the air/fuel ratio is rich relative to stoichiometry, the program proceeds through the steps 92 through 112 corresponding to the steps 70 through 90, respectively, with, however, the duty cycle of the carburetor control signal being increased by the delta duty cycle and base duty cycle to lean the air and fuel mixture supplied by the carburetor 12.

Referring to FIG. 5, there is illustrated the operation of the electronic control unit 18 during closed loop operation in accord with the program steps illustrated in FIG. 4. At time $t_0$, lean-to-rich transition in the air/fuel ratio occurs and is detected at step 92. At step 96, the rich flag is set to indicated that the air/fuel ratio is rich relative to the stoichiometric ratio. Thereafter and beginning at the time $t_0$, the delta duty cycle value (the first component of the closed loop carburetor control signal) increases from zero at a rate determined by the transport lag inverse determined at step 66 and the desired steady state limit cycle amplitude SSG in accord with the steps 94 and 102. The base duty cycle value (the second component of the closed loop carburetor control signal) remains constant since at step 100, it is determined that a transport time delay has not lapsed and the program proceeds directly to step 102. Consequently, the carburetor control duty cycle increases in accord with the sum of the base duty cycle and the delta duty cycle as illustrated to provide for an increase in the duty cycle provided to the carburetor 12 to increase the air/fuel ratio. After the period of a transport delay $T_{D1}$ has expired, the air/fuel ratio rich-to-lean transition is recognized, the system being operated at a steady state condition. At this time $t_1$, the rich flag is reset at step 74 and the delta duty cycle value is cleared to zero. Thereafter, the delta duty cycle value again increases at the rate determined by the transport lag inverse and the desired limit cycle amplitude. At step 80, this value is subtracted from the base duty cycle value resulting in a decreasing duty cycle value for decreasing the air/fuel ratio of the mixture supplied by the carburetor 12. Again, the base duty cycle value remains constant since at step 78, the program proceeds directly to the step 80. The aforementioned cycle is repeated as long as a steady state condition exists and the base duty cycle remains constant.

Beginning at time $t_2$, it is assumed that the transport time delay remains at the value $T_{D1}$ but the duty cycle value required to adjust the carburetor 12 to maintain a stoichiometric ratio increases. At time $t_2$, a lean-to-rich transition is detected at step 92. Thereafter, the delta duty cycle value increases from zero in accord with the value of the transport lag inverse and the steady state limit cycle amplitude SSG. After the expiration of the transport delay period $T_{D1}$ at time $t_3$, the rich flag remains set and the program determines at step 100 that the transport delay period has expired and an air/fuel ratio transient condition exists. Thereafter, the base duty cycle value begins to increase by an amount determined by the transport lag inverse and the steady state limit cycle amplitude SSG so that the base duty cycle increases at a rate substantially equal to the rate of increase of the delta duty cycle value between the times $t_2$ and $t_3$. Also at time $t_3$, the delta duty cycle value increases at a rate determined by the transport lag inverse and the transient gain amplitude TRG. Assuming the rich flag remains set for the duration of yet another transport time delay period $T_{D1}$, at $t_4$ the base duty cycle begins to increase at the same rate as the control duty cycle value between the times $t_3$ and $t_4$ as determined at step 112. However, the delta duty cycle value remains constant after time $t_4$ as limited by step 86. The net carburetor control duty cycle increases between times $t_3$ and $t_5$ as illustrated. At time $t_5$, the air/fuel sensor 20 senses a rich-to-lean excursion and the rich flag is reset at step 74. The delta duty cycle value is cleared at step 76 resulting in the proportional step illustrated at time $t_5$. However, the base duty cycle remains constant and the cycle is repeated as previously described beginning at time $t_0$. At time $t_5$, the carburetor control duty cycle was set to the duty cycle value that existed at time $t_4$ and which represents the duty cycle value required to adjust the carburetor 12 to produce a stoichiometric ratio. In the foregoing manner, the carburetor control duty cycle shifts to the value producing the stoichiometric ratio each time a transition is detected in the air/fuel ratio relative to the stoichiometric ratio.

Referring to FIG. 6, there is illustrated the carburetor control duty cycle at steady state conditions for two different transport delay periods. Beginning at time $t_0$, the transport delay period is equal to the time $T_{D1}$ snd the carburetor control duty cycle takes the form as illustrated with reference to FIG. 5. At a time prior to time $t_2$, the engine operation changes so that the transport delay decreases to a value $T_{D2}$. The delta duty cycle value increases at a rate greater than the rate when the transport delay period was equal to the value $T_{D1}$ since the transport lag inverse value determined at step 66 is greater with the shorter transport delay period. This is because the 100 millisecond major cycle period represents a larger portion of the transport delay period resulting in a larger value of transport lag inverse determined at step 66. Consequently at the steps 72 or 94, the integral control term increases by a greater amount resulting in the desired limit cycle amplitude being attained at the end of the transport time delay period $T_{D2}$.

The foregoing description of the preferred embodiment of the invention for purposes of illustrating the invention is not to be considered as limiting or restricting the invention since many modifications may be made by exercise of skill in the art without departing from the scope of the invention.

The embodiments of the invention in which an exclusive property or priviledge is claimed are defined as follows:

1. A fuel control system for an internal combustion engine having combustion space into which an air-fuel mixture is supplied to undergo combustion and having means defining an exhaust gas passage from the combustion space into which spent combustion gases are discharged and are directed to the atmosphere comprising, in combination:

supply means effective to supply a mixture of air and fuel to the combustion space;

a sensor responsive to the air/fuel ratio of the exhaust gases at a predetermined point in the exhaust gas passage and, hence, after a transport time delay period dependent upon engine operating conditions, to the mixture supplied to the combustion space, the sensor providing a sensor signal shifting abrupty between two values in accord with the sense of deviation of the air/fuel ratio form a predetermined ratio;

control means responsive to the sensor signal effective to [1] generate a first signal having a preset value of zero at each change in the sense of deviation of the air/fuel ratio from the predetermined ratio and varying therefrom at a predetermined rate, [2] generate a second signal having its value maintained constant for the period of the engine transport delay following each change in the sense of deviation of the air/fuel ratio from the predetermined ratio and thereafter varying at said predetermined rate and in a sense determined by the sense of deviation of the air/fuel ratio from the predetermined ratio, and (3) provide a control signal having a value in accord with the sum of the values of the first and second signals and varying in said sense determined by the sense of deviation of the air/fuel ratio from the predetermined ratio; and means responsive to the control signal effective to adjust the air/fuel ratio of the mixture provided by the supply means in a sense tending to restore the predetermined air/fuel ratio and by an amount in accord with the value of the control signal, whereby the control signal is effective to return the air/fuel ratio of the mixture supplied by the supply means to a value substantially equal to the value for producing the predetermined ratio at each change in the sense of the deviation of the air/fuel ratio from the predetermined ratio.

2. A fuel control system for an internal combustion engine having combustion space into which an air-fuel mixture is supplied to undergo combustion and having means defining an exhaust gas passage from the combustion space into which spent combustion gases are discharged and are directed to the atmosphere comprising, in combination:

supply means effective to supply a mixture of air and fuel to the combustion space;

a sensor responsive to the air/fuel ratio of the exhaust gases at a predetermined point in the exaust gas passage and, hence, after a transport time delay period dependent upon engine operating conditions, to the mixture supplied to the combustion space, the sensor providing a sensor signal shifting abruptly between two values in accord with the sesne of deviation of the air/fuel ratio from a predetermined ratio;

means effective to provide a transport lag inverse signal having a value equal to the fraction of the value of the engine transport delay represented by a predetermined time period;

control means responsive to the sensor signal effective to [1] generate a first signal having a preset value of zero at each change in the sense of deviation of the air/fuel ratio from the predetermined ratio and varying therefrom during each of successive time periods equal to the predetermined time period by an amount equal to the fraction represented by the transport lag inverse signal times a predetermined limit cycle amplitude, [2] generate a second signal having its value maintained constant for the period of the engine transport delay following each change in the sense of deviation of the air/fuel ratio from the predetermined ratio and thereafter varying during each of successive time periods equal to the predetermined time period by an amount equal to the fraction represented by the transport lag inverse signal times the predetermined limit cycle amplitude, and [3] provide a control signal having a value in accord with the sum of the values of the first and second signals and varying in a sense determined by the sense of deviation of the air/fuel ratio from the predetermined ratio; and means responsive to the control signal effective to adjust the air/fuel ratio of the mixture provided by the supply means in a sense tending to restore the predetermined air/fuel ratio and by an amount in accord with the value of the control signal, whereby the control signal is effective to return the air/fuel ratio of the mixture supplied by the supply means to a value substantially equal to the value for producing the predetermined ratio at each change in the sense of the deviation of the air/fuel ratio from the predetermined ratio and is effective to maintain the predetermined limit cycle amplitude at varying transport time delay periods.

3. A fuel control system for an internal combustion engine having combustion space into which an air-fuel mixture is supplied to undergo combustion and having means defining an exhaust gas passage from the combustion space into which spent combustion gases are discharged and are directed to the atmosphere comprising, in combination:

supply means effective to supply a mixture of air and fuel to the combustion space;

a sensor responsive to the air/fuel ratio of the exhaust gases at a predetermined point in the exhaust gas passage and, hence, after a transport time delay period dependent upon engine operating conditions, to the mixture supplied to the combustion space, the sensor providing a sensor signal shifting abruptly between two values in accord with the sense of deviation of the air/fuel ratio from a predetermined ratio;

control means responsive to the sensor signal effective to provide a control signal comprised of the sum of a first signal having a preset value of zero at each change in the sense of deviation of the air/fuel ratio from the predetermined ratio and a second signal, said control means including means effective during each of successive intervals to [1] generate a time lag inverse signal having a value that is the percentage of the transport time delay period represented by each of the successive intervals, [2] vary the value of the first signal by an amount that is equal to the percentage represented by the transport lag inverse signal times a desired limit cycle amplitude, and [3] vary the value of the second signal after the expiration of an engine transport delay period following each change in the sense of deviation of the air/fuel ratio from the predetermined ratio by an amount equal to the percentage represented by the time lag inverse signal times the desired limit cycle amplitude; and means responsive to the control signal effective to adjust the air/fuel ratio of the mixture provided by the supply means in a sense tending to restore the predetermined air/fuel ratio and by an amount in accord with the value of the control signal.

4. The fuel control system of claim 1 wherein the control means responsive to the sensor signal is further effective to vary the first signal at a second predetermined rate greater than the first mentioned predetermined rate after the period of the engine transport delay following each change in the sense of the air/fuel ratio representing a transient engine condition, the second predetermined rate providing improved control system response to transient conditions.

* * * * *

UNITED STATES PATENT AND TRADEMARK OFFICE

CERTIFICATE OF CORRECTION

PATENT NO. : 4,290,400

DATED : September 22, 1981

INVENTOR(S) : Allen J. Pomerantz

It is certified that error appears in the above—identified patent and that said Letters Patent is hereby corrected as shown below:

Column 5, line 58, "intialization" should read -- initialization --.

Column 6, line 41, "code" should read -- mode --.

Column 8, line 67, -- duty -- should be inserted after "delta".

Column 10, line 10, "indicated" should read -- indicate --.

Column 11, line 19, "snd" should read -- and --.

Column 11, line 60 (claim 1) "abrupty" should read -- abruptly --.

Signed and Sealed this

*Twenty-seventh* Day of *April 1982*

[SEAL]

*Attest:*

GERALD J. MOSSINGHOFF

*Attesting Officer*

*Commissioner of Patents and Trademarks*